US006298973B1

(12) United States Patent
Meade et al.

(10) Patent No.: US 6,298,973 B1
(45) Date of Patent: Oct. 9, 2001

(54) MULTIPLE COIN ANALYZER SYSTEM

(75) Inventors: Mark H. Meade, Muskegon; Douglas O. Parker; Keith W. Parker, both of Grand Rapids, all of MI (US)

(73) Assignee: Parker Engineering & Manufacturing Co., Inc., Grand Rapids, MI (US)

( * ) Notice: Subject to any disclaimer, the term of this patent is extended or adjusted under 35 U.S.C. 154(b) by 0 days.

(21) Appl. No.: 09/438,002

(22) Filed: Nov. 10, 1999

(51) Int. Cl.[7] ..... G07D 5/08
(52) U.S. Cl. ..... 194/318
(58) Field of Search ..... 194/317, 318, 194/319

(56) References Cited

U.S. PATENT DOCUMENTS

| | | | | |
|---|---|---|---|---|
| 3,741,363 | * | 6/1973 | Hinterstocker | 194/318 |
| 3,966,034 | * | 6/1976 | Heiman et al. | 194/318 |
| 4,432,447 | * | 2/1984 | Tanaka | 194/318 |
| 4,884,672 | | 12/1989 | Parker | 194/318 |
| 5,056,644 | | 10/1991 | Parker | 194/318 |
| 5,078,251 | * | 1/1992 | Hayaski et al. | 194/318 |
| 5,129,501 | | 7/1992 | Halsey et al. | 194/350 |
| 5,211,275 | | 5/1993 | Halsey et al. | 194/350 |
| 5,226,520 | | 7/1993 | Parker | 194/317 |
| 5,293,980 | | 3/1994 | Parker | 194/317 |
| 5,433,310 | | 7/1995 | Bell | 194/318 |
| 5,439,089 | | 8/1995 | Parker | 194/317 |
| 5,454,463 | | 10/1995 | Meyer | 194/217 |
| 5,480,019 | * | 1/1996 | Furuya | 194/318 |
| 5,490,588 | | 2/1996 | Nishiumi et al. | 194/317 |
| 5,495,931 | | 3/1996 | Meyer-Steffens et al. | 194/317 |
| 5,535,872 | | 7/1996 | Smith et al. | 194/317 |
| 5,564,546 | | 10/1996 | Molbak et al. | 194/216 |
| 5,566,808 | | 10/1996 | Parker et al. | 194/317 |
| 5,568,855 | | 10/1996 | Hoffman et al. | 194/318 |
| 5,579,887 | | 12/1996 | Leibu et al. | 194/317 |
| 5,620,079 | | 4/1997 | Molbak | 194/217 |
| 5,676,234 | | 10/1997 | Smith et al. | 194/346 |
| 5,687,830 | * | 11/1997 | Hayes et al. | 194/318 |
| 5,697,484 | | 12/1997 | Yeh | 194/318 |
| 5,746,299 | | 5/1998 | Molbak et al. | 194/200 |
| 5,799,767 | | 9/1998 | Molbak | 194/217 |
| 5,799,768 | | 9/1998 | Bernier et al. | 194/318 |
| 5,823,315 | | 10/1998 | Hoffman et al. | 194/203 |
| 5,842,916 | | 12/1998 | Gerrity et al. | 453/57 |
| 5,909,793 | | 6/1999 | Beach et al. | 194/210 |
| 5,909,794 | | 6/1999 | Molbak et al. | 194/216 |

OTHER PUBLICATIONS

Product brochure entitled "Microcoin . . . The coin acceptor for the future is here NOW!," MicrosystemControls Pty. Ltd., Melbourne, Australia, date unknown.
Product brochure entitled "Magikist, CoinPro Multi–Coin Coin Acceptor," Canada, date unknown.
Product brochure entitled "Model MA 800 Hawk Xeptor, Smart Multi–Coin and Token Acceptor," IDX Incorporated, El Dorado, Arizona, date unknown.
Product brochure entitled "Model X–10 X–Mark Xeptor, Smart Multi–Coin and Encoded Token Acceptor," IDX Incorporated, El Dorado, Arizona, date unknown.

* cited by examiner

*Primary Examiner*—F. J. Bartuska
(74) *Attorney, Agent, or Firm*—Van Dyke, Gardner, Linn & Burkhart, LLP

(57) ABSTRACT

A method and apparatus for discriminating among a plurality of coin denominations includes sensing the characteristics of a test coin with a test coin sensor and comparing the characteristics of the test coin with characteristics of a plurality of coin denominations thereby producing comparison signals. If the comparing results in a match between the characteristics of the test coin and characteristics of one of the coin denominations, then the test coin is declared to be the matched coin denomination. If the comparing results in matches between the characteristics of the test coin and characteristics of more than one of the coin denominations, then the matches are compared to each other to determine which of the matches represents a valid match. The test coin is declared to be the coin denomination which corresponds to the valid match.

38 Claims, 12 Drawing Sheets

MULTIPLE COIN ANALYZER SYSTEM

BACKGROUND OF THE INVENTION

This invention relates generally to coin analyzers or discriminators and, more particularly, to coin analyzers that are capable of distinguishing among a plurality of coins. The invention is useful with various coin-operated machines; for example, video games, car washes, clothes washers and dryers, coin counters, and the like.

The invention in commonly assigned U.S. Pat. Nos. 4,884,672 and 5,056,644 provided the first commercially successful coin analyzer that was capable of detecting two coins, or a coin and token. In such commonly owned patents, a sample coin holder held two coin denominations or a coin and token adjacent to associated sample coin coil assemblies. A test coin coil assembly was located at a coin path. A circuit compared the effect on the magnetic field at the test coin assembly with the sample coin coil assemblies in order to determine when a match occurred between a test coin and one of the sample coins. The coin analyzer disclosed in these commonly assigned patents utilized analog circuitry to operate a kicker coil to accept a valid coin and in order to provide a credit indication of the amount of valid coins accepted.

Since the introduction of the Slug Buster II coin analyzer, which embodied the invention in the '672 and '644 patents, other multiple coin analyzers have been developed. These other coin analyzers typically utilize a microprocessor in combination with a test coil assembly and other input circuitry. The microprocessor stores characteristics of various coin denominations. When a coin is inserted in the coin path, the output of the test coil is applied to the microprocessor through the input circuitry. The microprocessor attempts to identify a match between the characteristics of the test coin and those stored within the microcomputer. If a match occurs, then a particular coin is deemed to have been identified. Such coin analyzers typically have a learning mode in which the coins to be identified are juxtaposed with the test coil while the microprocessor stores the parameters of each denomination coin.

One difficulty arises with coins of very similar characteristics. For example, the United States Mint introduced the Susan B. Anthony dollar coin which was made from a five-layer clad blank. The United States quarter is also made from a five-layer clad blank similar to that from which the Susan B. Anthony dollar is made. As a result, commercially available coin analyzers are incapable of accurately discriminating between a Susan B. Anthony dollar and a United States quarter. Other countries have such coins of similar properties. Also, coins from one country may have similar properties to a coin of another country. The inability of coin analyzers to distinguish between two coins having similar properties is a serious deficiency that heretofore has created a long-felt need in the art of coin analyzers. The present invention satisfies this long-felt need.

SUMMARY OF THE INVENTION

The present invention provides a coin discrimination apparatus and method which is capable of repeatedly and accurately discriminating between coins of similar properties, including, by way of example, United States quarters and Susan B. Anthony dollars. A coin discrimination apparatus, according to an aspect of the invention, includes a test coin sensor that is adapted to sense a coin to be detected and including a test coin coil assembly. A microprocessor-based control is responsive to the test coin coil assembly to determine whether a test coin at the test coin sensor matches any of a plurality of coin denominations including resolving matches of a test coin at the test coin sensor with more than one of the plurality of coin denominations.

According to another aspect of the invention, a coin discrimination apparatus includes a plurality of sample coin assemblies, each including a sample coin holder and a sample coil assembly. The sample coil assembly generates a sample field and senses a sample field with the holder holding a sample coin. The apparatus further includes a test coin sensor including a coin guide path and a test coil assembly. The test coil assembly generates a test field and senses a test field with a test coin at the guide path. The apparatus further includes a microprocessor-based control which compares the test coil assembly with each of the sample coil assemblies and determines whether a test coin at the guide path matches a sample coin at one of the sample coin holders. The microprocessor-based control resolves matches of a test guide at the guide path with sample coins at more than one of the sample coin holders.

This is accomplished, according to a more detailed aspect of the invention, by the control determining which of the coins at more than one of the sample coin assemblies indicates a match with a coin at the test coin sensor. Substantially throughout the duration, the test coin is at the test coin sensor. The control, according to this more-detailed aspect of the invention, determines which of the coins at more than one of the sample coin assemblies first indicates a match with the coin at the test coin sensor.

A method of discriminating among a plurality of coin denominations includes sensing the characteristics of a test coin and comparing the characteristics of the test coin with characteristics of a plurality of coin denominations. If the comparing results in a match between the characteristics of the test coin and the characteristics of one of the coin denominations, then the test coin is declared to be that one of the coin denominations. If the comparing results in matches between the characteristics of the test coin and the characteristics of the test coin and the characteristics of more than one of the coin denominations, then the matches are compared to each other to determine which of the matches represents a valid match. The test coin which represents the valid one of the matches is declared the denomination of the test coin.

A method of discriminating denominations of coins, according to another aspect of the invention, includes providing a plurality of sample coin assemblies in a test coin sensor, each of the sample coin assemblies is adapted to hold a coin to be detected and includes a sample coin coil assembly. The test coin coil assembly is adapted to sense a coin to be detected and includes a test coin coil assembly. The method further includes comparing the test coin coil assembly with each of the sample coin coil assemblies with a microprocessor-based control and determining whether a test coin at the test coin sensor matches a sample coin at one of the sample coin assemblies. The method further includes determining whether any of the coins at more than one of the sample coin assemblies indicates a match with the coin at the test coil sensor during the entire time the test coin is at the coil sensor and which of the coins at more than one of the sample coin assemblies first indicates a match with a coin at the test coin sensor.

By resolving indications from multiple matches between the test coin and more than one denomination, the present invention is capable of determining which of the denominations truly matches the test coin. The present invention is capable of being scaled to accept one or more coin denominations and a token and can be expanded theoretically up to an unlimited number of coins and any combination of coins and tokens to be accepted.

These and other objects, advantages and features of this invention will become apparent upon review of the following specification in conjunction with the drawings.

DESCRIPTION OF THE PREFERRED EMBODIMENT

Figure 1:
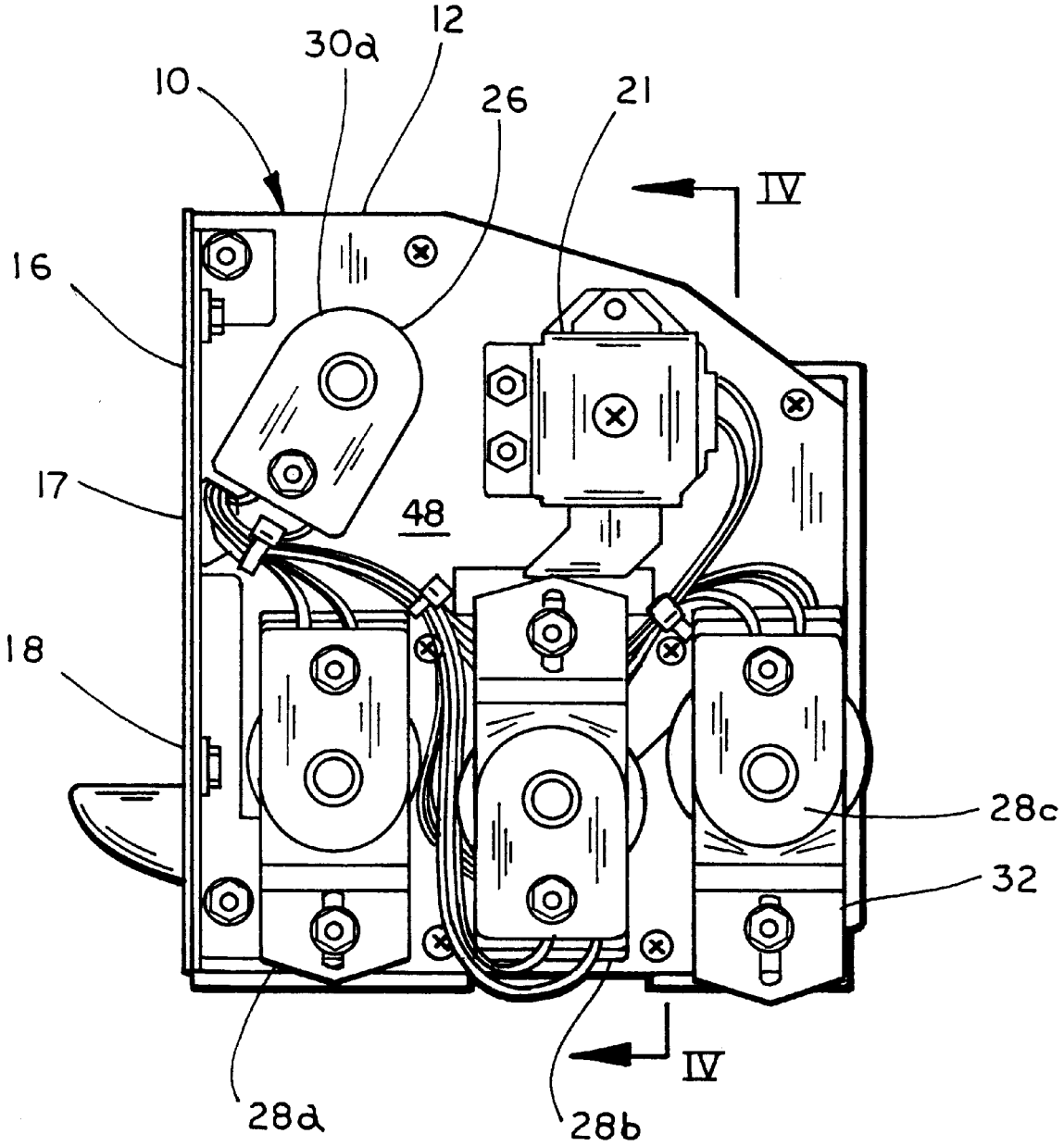
FIG. 1 is a side elevation of a coin analyzer according to the invention.
Figure 2:
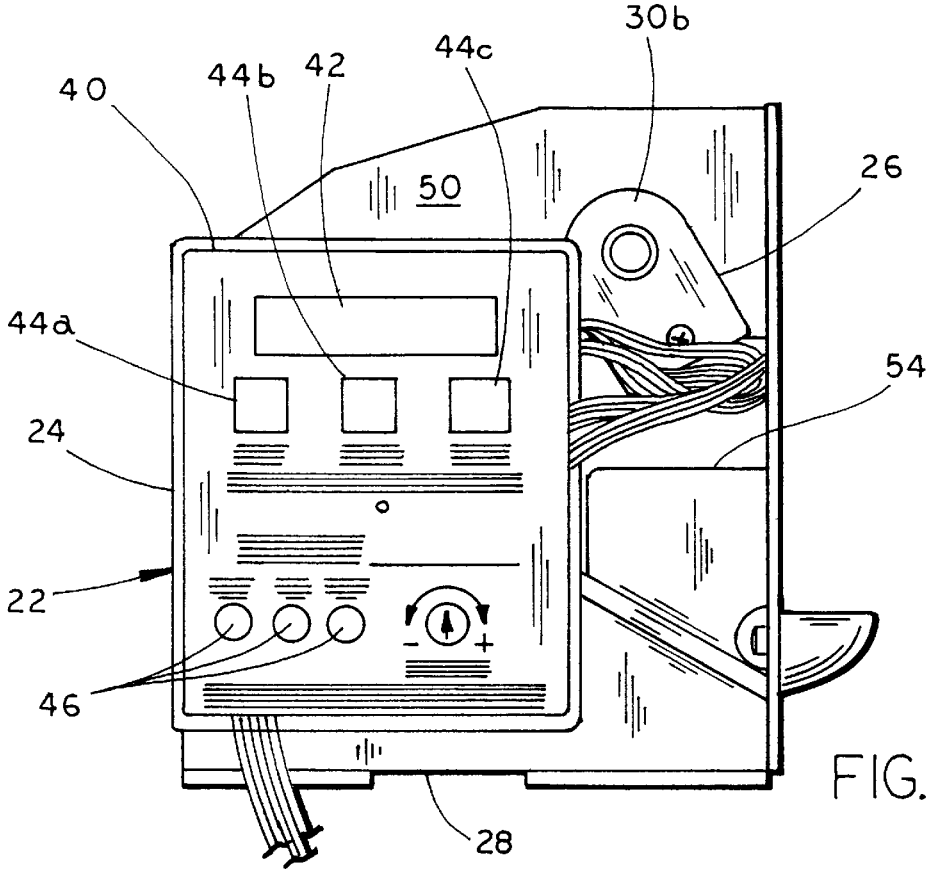
FIG. 2 is a side elevation opposite that side shown in FIG. 1.
Figure 3:
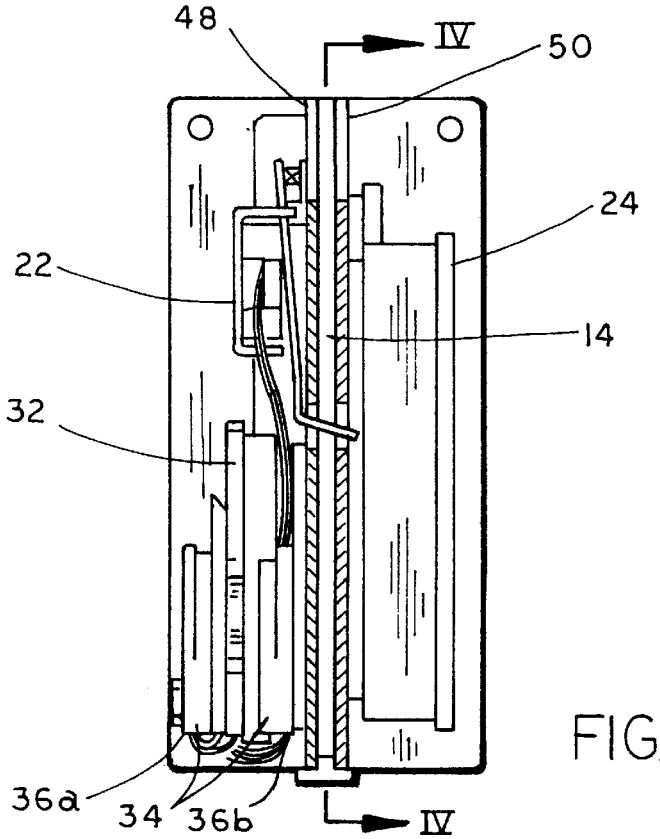
FIG. 3 is a sectional view taken along the lines III—III in FIG. 1.

Referring now specifically to the drawings, and the illustrative embodiments depicted therein, a coin analyzer 10 includes a chassis, or frame, 12 which defines a coin path, or guide path, 14 extending from a coin receiving slot 16 in a faceplate 17 and terminating in a coin reject slot 18 and a coin acceptance slot 20 (FIGS. 1–5). The term coin is intended to include not only legal tender, but, also, various tokens, and the like. The coin reject slot 18 is also in faceplate 17. The coin acceptance slot 20 extends to a cash box (not shown). An electromagnetic device, referred to as a kicker coil 21, is activated in order to deflect a coin inserted in coin path 14 to acceptance slot 20. If kicker coil 21 is not activated, then the coin falls to coin rejection slot 18. It should be understood that the invention could also be used with the reverse logic in which kicker coil 21 must be activated in order to reject a coin.

Coin analyzer 10 additionally includes a microprocessor-based control 22 including an electronic module 24, a test coin sensor 26, and a plurality of sample coin assemblies 28*a*–28*c*. Test coin sensor 26 has a test coil assembly which generates a test field and senses a test field with a test coil in coin path 14. In the illustrated embodiment, this is accomplished by separate field-generating coil 30*a* and sensing coil 30*b*. However, other configurations of a test coil sensor known in the art may be employed such as one that both generates a field and senses the field with one coil. Each sample coil assembly 28*a*–28*c* includes a sample coin holder 32 and a sample coil assembly 34 which generates a sample field and senses a sample field as modified by the coin position in the associated sample coin holder 32. In the illustrated embodiment, separate sample field-generating coils 36*a* and field-sensing coils 36*b* are provided. However, other sample coil configurations may be utilized. Test coil sensor, sense sample coil assembly and kicker coil 21 are generally as described in commonly assigned U.S. Pat. Nos. 4,884,672 and 5,056,644, the disclosures of which are hereby incorporated herein by reference.

Electronic module 24 includes a solid-state electronic circuit 38 enclosed within a housing 40 which may be sealed to avoid the entry of moisture for particular applications, such as car washes, laundry machines, and the like. Electronic module 24 may additionally include a display 42 for use in setting up the operating parameters, such as programming the value for each channel established by its respective sample coin or token and other parameters. Display 42 additionally provides an audit function during operation of coin analyzer 10, such as identifying the number of coins that have passed through the coin analyzer per channel and the like. Electronic module 24 additionally includes switches 44*a*–44*c* which are useful in programming electronic module 24. Adjustment screws 46 are used to tune a particular coin in each of the sample coin holders 32 to the same coin position at test coin sensor 26.

Sample coin assembly 28*b* is vertically reversed with respect to sample coins 28*a* and 28*c* in its position on chassis 12. This provides preferable routing of wires to and from the sample coin holders as well as provides ease of access to the sample coin holders for inserting and removing sample coins therefrom. Additionally, sample coin assemblies 28*a*–28*c* are all horizontally aligned on chassis 12. This facilitates use of coin analyzer 10 with either a short-drop faceplate or a long-drop faceplate.

Figure 4:
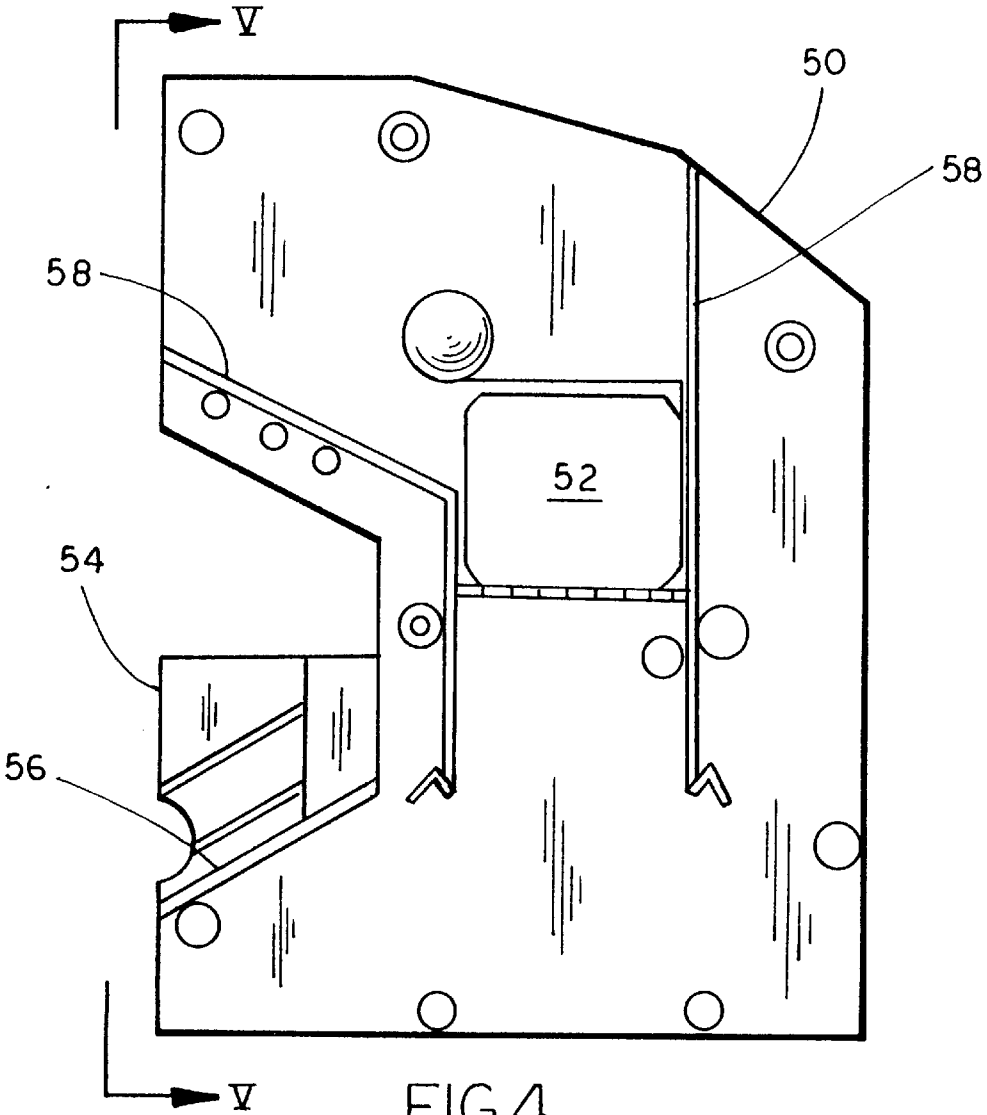
FIG. 4 is a sectional view taken along the lines IV—IV in FIG. 3.
Figure 5:
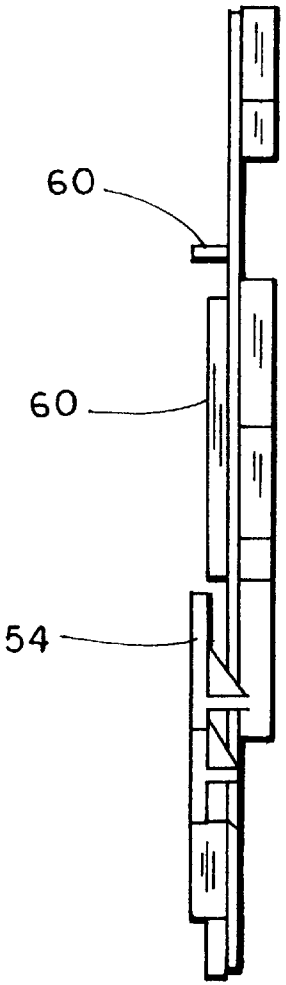
FIG. 5 is an end elevation indicated at V—V in FIG. 4.
Figure 6:
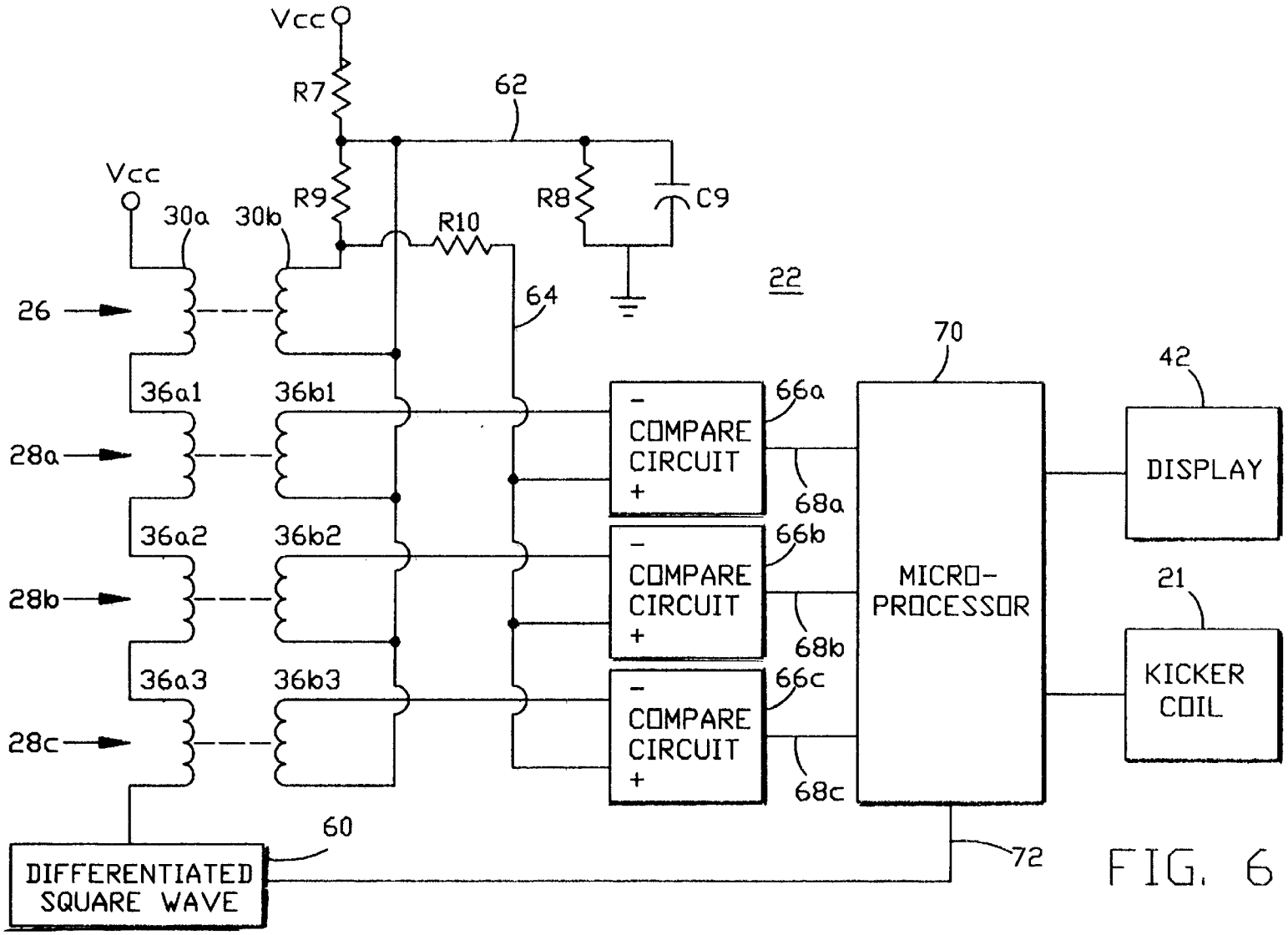
FIG. 6 is a block diagram illustrating a microprocessor-based control according to the invention.

Chassis 12 is made up of a baseplate 48 and a side panel 50. As seen in FIGS. 4 and 5, side panel 50 includes an opening 52 through which rejected coins are diverted and an offset side portion 54 which, in combination with a back surface of housing 40, defines a rejected coin path. The rejected coin path also includes a sloped lower surface 56 for supporting rejected coins. Side panel 50 additionally includes side extensions 58 extending from one side thereof in order to space baseplate 48 from side panel 50 defining coin paths 14 therebetween. Side panel 50 additionally includes oppositely directed side extension 60 in order to provide offset support for housing 40 defining a rejected coin path therebetween. In the illustrated embodiment, side panel 50 is made from a generally transparent plastic material in order to provide visual access to the coin path for observance of jams and the like.

Microprocessor-based control 22 includes coils 30*a* and 30*b* of test coin sensor 26 and a pair of coils 36*a*1 and 36*b*1 of one sample coil assembly 34, a pair of coils 36*a*2 and 36*b*2, which make up another sample coil assembly 34, and another pair of coils 36*a*3 and 36*b*3, which make up yet another sample coil assembly (FIGS. 6–9*b*). If more than three sample coil assemblies 34 are utilized, they would be connected in a similar fashion as those illustrated in FIG. 6. Coils 30*a*, 36*a*1, 36*a*2 and 36*a*3 are electrically series connected between a voltage source Vcc and a differentiated square wave generator 60. In this manner, coils 30*a*, 36*a*1, 36*a*2 and 36*a*3 generate an electromagnetic field which is coupled respectively with the test coin and the three sample coins in sample coin holders 28*a*–28*c*. Each of the coils 30*b*, 36*b*1, 36*b*2 and 36*b*3 are sensing coils which sense magnetic fields generated by the respective field-generating coils 30*a*, 36*a*1, 36*a*2, and 36*a*3 as modified by the respective test coin and sample coins juxtaposed with the coils. Each coil 30*b*, 36*b*1, 36*b*2 and 36*b*3 has a common terminal connected together with a junction 62 between resistors R7, R8 and R9. The other junction of coil 30*b* is connected at 64 with a non-inverting input of compare circuits 66*a*, 66*b* and 66*c*. The other terminal of coil 36*b*1 is supplied to the inverting input of compare circuit 66*a*. The other terminal of coil 36*b*2 is applied to the inverting input of compare circuit 66*b*. The other terminal of coil 36*b*3 is connected with the inverting input of compare circuit 66. Outputs 68*a*, 68*b* and 68*c* of respective compare circuits 66*a*–66*c* are supplied as channel inputs to a microprocessor 70. microprocessor 70 has an output made up of a plurality of display lines 73 to provide data to display 42. Microprocessor 70 additionally has an output to kicker coil 21 through a suitable interface thereof. Microprocessor 70 additionally produces an output 72 in order to operate differentiated square wave generator 60. This allows the microprocessor to control the manner of operation of differentiated square wave 60. In the illustrated embodiment, differentiated square wave 60 is operated at a constant 6 kilohertz differentiated square wave.

In operation, when a test coin traverses coin path 14, it passes between coils 30*a* and 30*b*. Each coil 36*b*1, 36*b*2 and 36*b*3 produces a signal which is compared with coil 30*b* by compare circuits 66*a*–66*c*. If the test coin substantially matches the magnetic characteristics of one or more of the sample coins, the respective compare circuits 66*a*–66*c* will change output states on respective channel line 68*a*–68*c* as the test coin traverses 30*a* and 30*b*. The output of compare circuits 66*a*–66*c* changes state only during the periods when a substantial similarity between the characteristics of the test coil and the respective sample coils. Therefore, each channel 68*a*–68*c* may change states only a portion of the time that the test coin is juxtaposed with test coils 30*a* and 30*b* and may change states multiple times during the traversing of coils 30*a*, 30*b* by the test coin. Also, if two or more of the sample coins are similar in property, more than one channel line 68*a*–68*c* may change states as a test coin traverses coils 30*a*, 30*b*. For example, if a United States quarter is positioned in one of the sample coin holders 32 and a Susan B. Anthony dollar is positioned in another sample coin bolder 32, it is possible that the respective outputs may both change states as a United States quarter or a Susan B. Anthony dollar traverses coin path 14.

Channels 68*a*–68*c* are monitored by microprocessor 70 which includes a program 74 to determine which sample coin the test coin matches. If the test coin matches one of the sample coins, microprocessor 70 actuates kicker coil 21 to pass the coin or token to the cash box (not shown). Microprocessor 70 continuously samples outputs 68*a*–68*c* and begins to store the samples when one output changes state. Microprocessor 70 stores multiple samples of all outputs that are made during the period that a typical coin traverses the test coin sensor 26.

Figure 7:
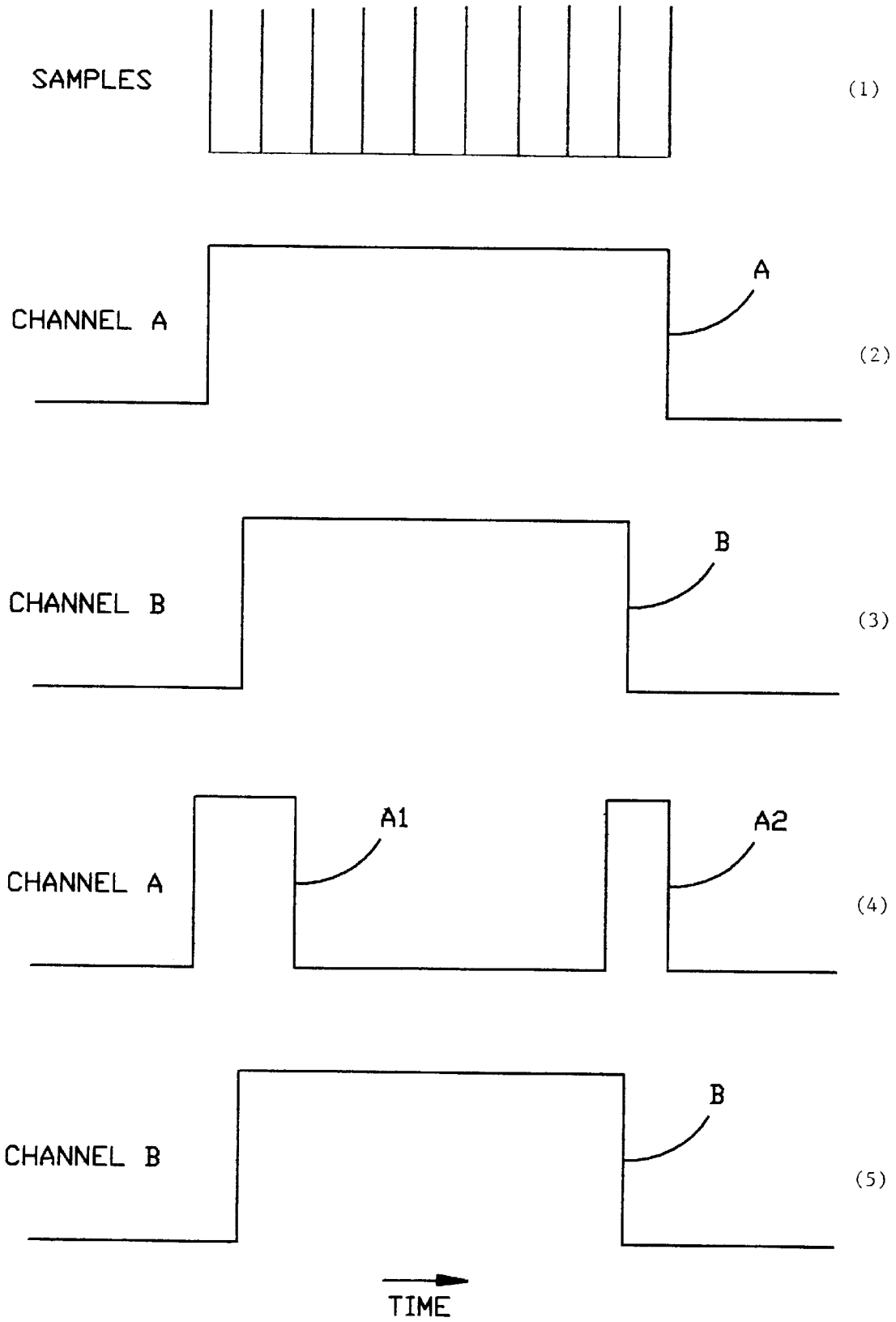
FIG. 7 is a diagram illustrating comparisons of multiple channels, each indicating a match with the test coin.

In the illustrative embodiment, 10 samples are stored for all channels 68*a*–68*c* extending for a duration of 20 milliseconds, although other sample rates and periods may be selected by the skilled artisan. Diagram (1) in FIG. 7 shows the 2 millisecond samples stored by the microprocessor. Typically, one channel 68*a*–68*c* will change state as a test coin traverses test coin sensor 26. However, if two or more sample coins have similar properties, more than one test channel 68*a*–68*c* may change states as illustrated in FIG. 7. Diagrams (2) and (3) in FIG. 7 illustrate the situation where two output channels change state throughout the entire time that a test coin traverses test coin sensor 26. Diagrams (4) and (5) in FIG. 7 illustrate the situation where one channel, in this case, channel A, momentarily changes state, but then returns to its original state, and then changes state again as the test coin passes the test coin sensor 26. In diagrams (2) and (3) in FIG. 7, microprocessor 70 selects channel A as the proper match to the test coin. The reason is that, in the circumstance where both channels change state and maintain that change of state, the first channel to change states will be selected for reasons that will be discussed below. In the case of diagrams (4) and (5) where one channel momentarily changes state, but dips back to an original state prior to once again changing state, the microprocessor 70 selects the channel which maintains its change of state throughout the sampling process. Microprocessor 70 selects channel B, even though channel A initially changes state before channel B for reasons that will now be discussed.

The basis for the logic used by microprocessor 70 is as follows. When two channels change state and maintain the change of state throughout the test coin sampling, the first to change state is considered to produce the strongest signal and, therefore, the proper match with the test coin. When, however, one channel momentarily changes state, but reverts to its original state, and then again changes state, the channel which maintains the change of state is selected. This logic is based upon the belief that two coins of similar property are more likely to give an erroneous match indication during the leading and trailing edge of the coin as the coin traverses the sample coin assembly. For example, it has been discovered that the United States Susan B. Anthony dollar has very similar characteristics to a quarter at the leading and trailing edge of the dollar, but not when the dollar is centrally juxtaposed with the test coin sensor. Other relationships of multiple-activated channels may suggest themselves to the skilled artisan.

Figure 8A:
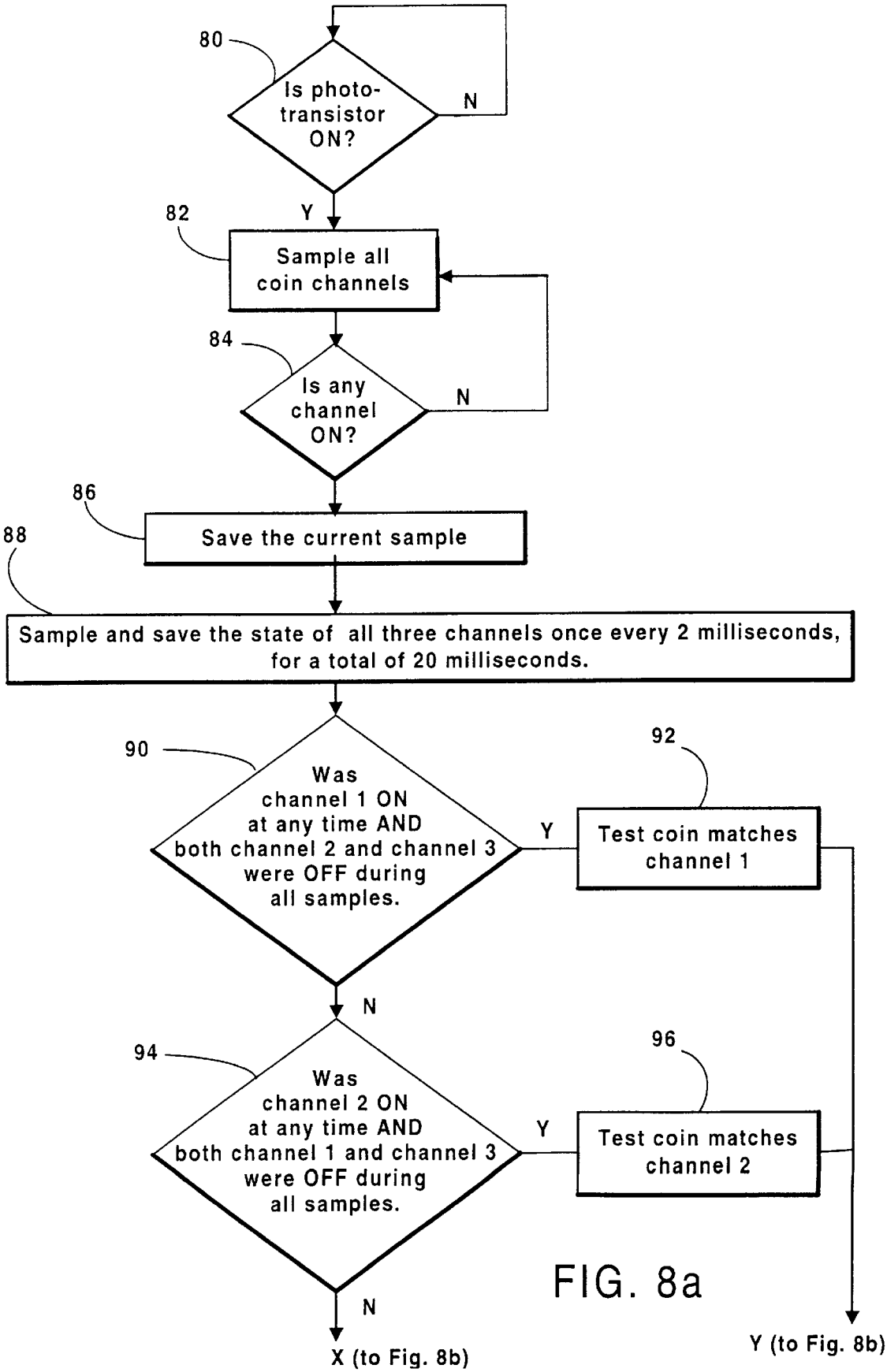
FIGS. 8*a*–8*c* are flowcharts illustrating a control algorithm according to the invention.
Figure 8B:
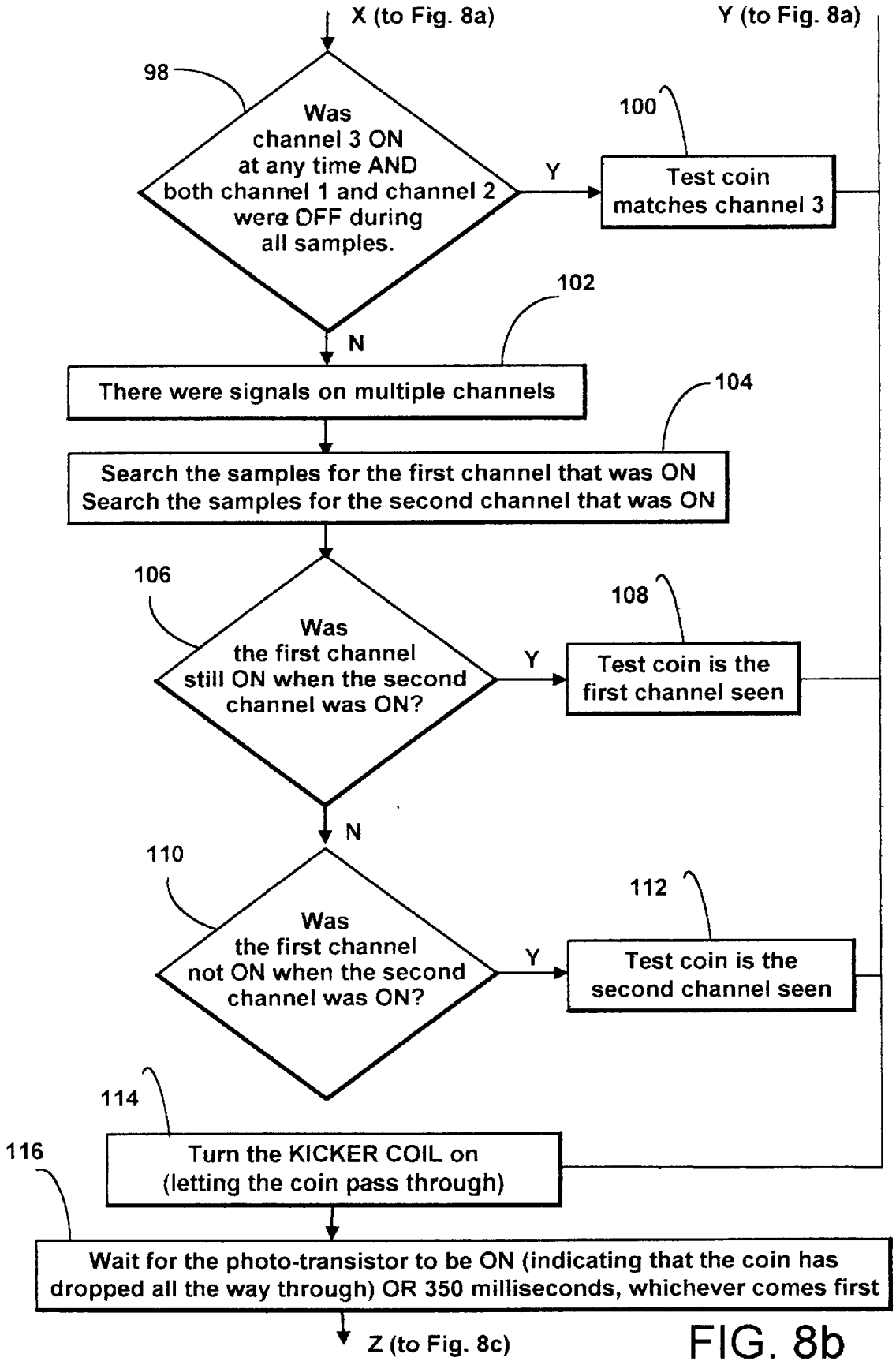
Figure 8C:
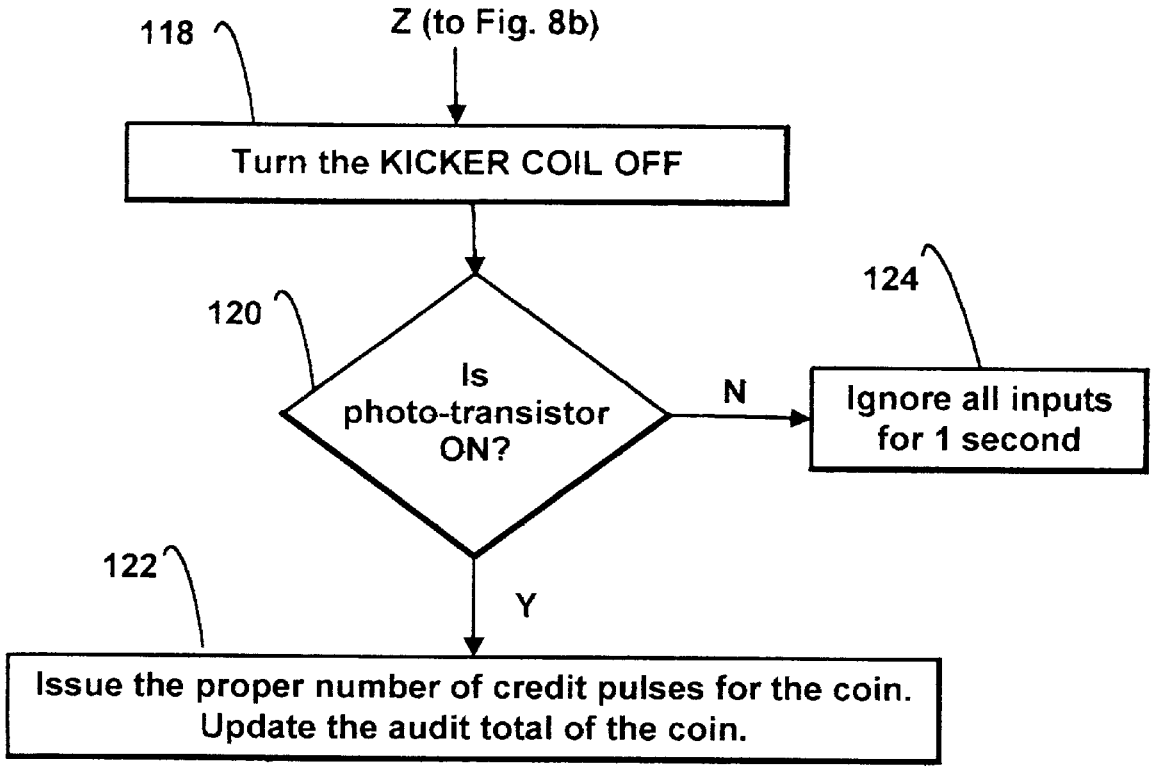

A flowchart of the control program run on microprocessor 70 is illustrated in FIGS. 8*a* and 8*b*. Control program 74 begins by monitoring the phototransistor positioned downstream of coin acceptance slot 20. If it is determined at 80 that the phototransistor is on, indicating that no coin is blocking the phototransistor, the program samples at 82 all coin channels on outputs 68*a*–68*c*. If no channels are on, then the control program continues to sample all of the coin channels at a periodic rate. When it is determined at 84 that a coin channel is on, the microprocessor samples and saves the states of all three channels once every 2 milliseconds for a total of 20 milliseconds. When it is determined at 86 that a coin is present, the program determines at 90 whether channel 1 was on at any time and both channels 2 and 3 were off during all samples. If this condition is true, the program determines at 92 that the test coin matches channel 1. If this condition is not true, then the program determines at 94 whether channel 2 was on at any time and both channels 1 and 3 were off during all samples. If this is true, then the program determines at 96 that the test coin matches 2. If this is not true, then the program determines at 98 whether channel 3 was on at any time and both channels and 1 and 2 were off during all samples. If this is true, then the program determines at 100 that the test coin matches channel 3. If this is not true, then the program concludes at 102 that there were signals on multiple channels and requires further evaluation to determine which of the matches is the correct match.

Program 74 then searches at 104 for samples for the first channel that was on and searches for samples for the second channel that was on. It is then determined at 106 whether the first channel was still on when the second channel was on. If it is determined at 106 that the first channel was still on when the second channel was on, the program determines at 108 that the test coin is the first channel seen. If it is determined at 106 that the first channel was not still on when the second channel was on, then it is determined at 110 whether the first channel was not on when the second channel was on. If the first channel was not on when the second channel was on, then the test coin is determined to be the second channel seen. If the determination at 110 is negative, the control rejects the coin (not shown). Likewise, if the control senses that more than two channels are on, the control concludes that the coin analyzer is not functioning properly and rejects the coin.

After a determination is made (92, 96, 100, 108, 112) of which channel matches the test coin, the control then turns the kicker coil on at 114 in order to let the coin pass through. The control then waits at 116 for the phototransistor to be on which indicates that a coin has dropped all the way through. If the phototransistor does not come on for 350 milliseconds, the control no longer waits for the phototransistor to be on. The kicker coil is turned off at 118 and it is determined at 120 whether the phototransistor is on. If it is determined at 120 that the photo-transistor is on, then the proper number of credit pulses is issued for the coin at 122. Also, the audit total for the coin is updated. If it is determined at 120 that the phototransistor is not on, then all inputs are ignored for 1 second at 124.

Figure 9A:
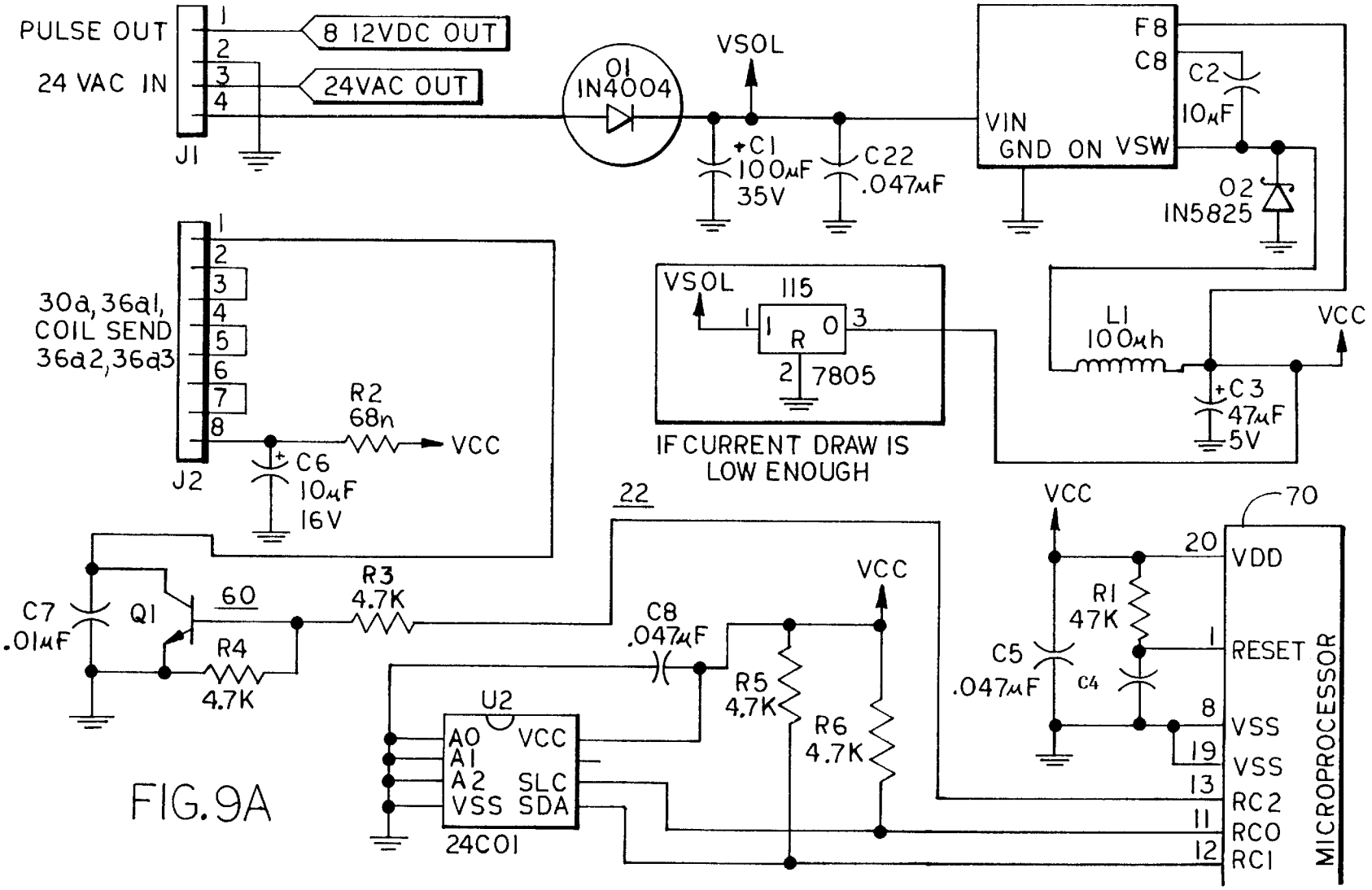
FIGS. 9*a*–9*d* are a detailed electrical schematic diagram of the control in FIG. 6.
Figure 9B:
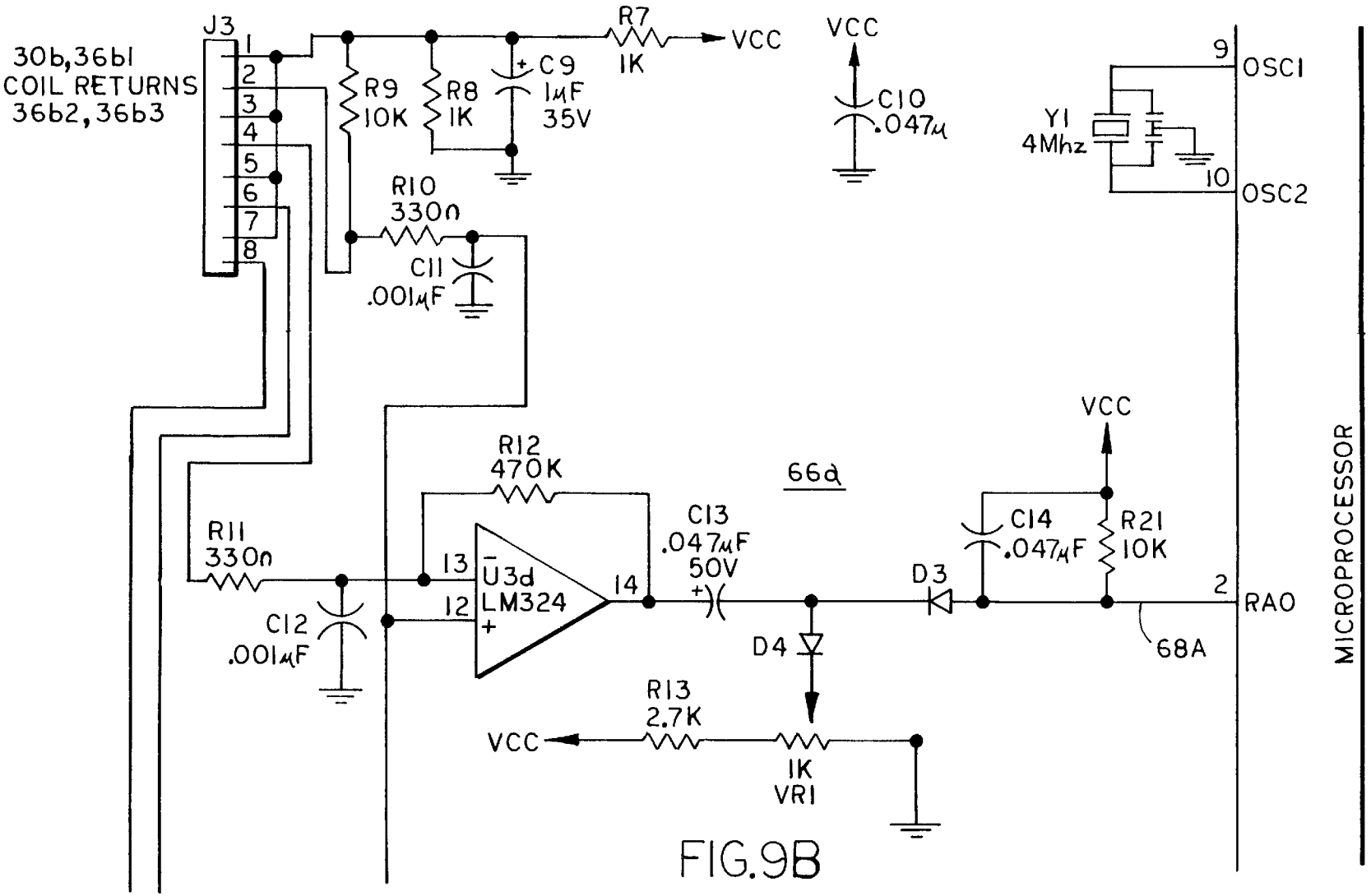
Figure 9C:
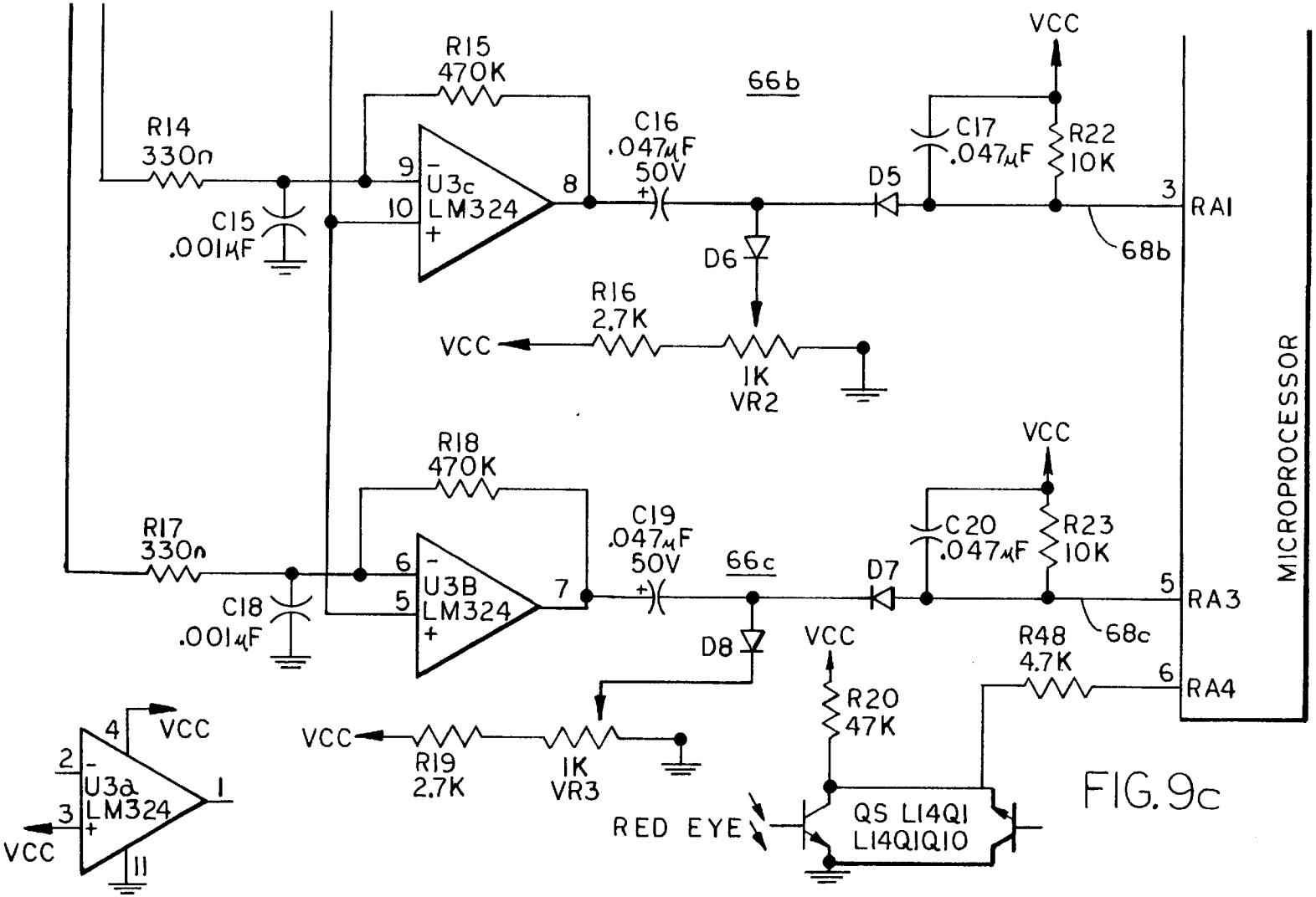
Figure 9D:
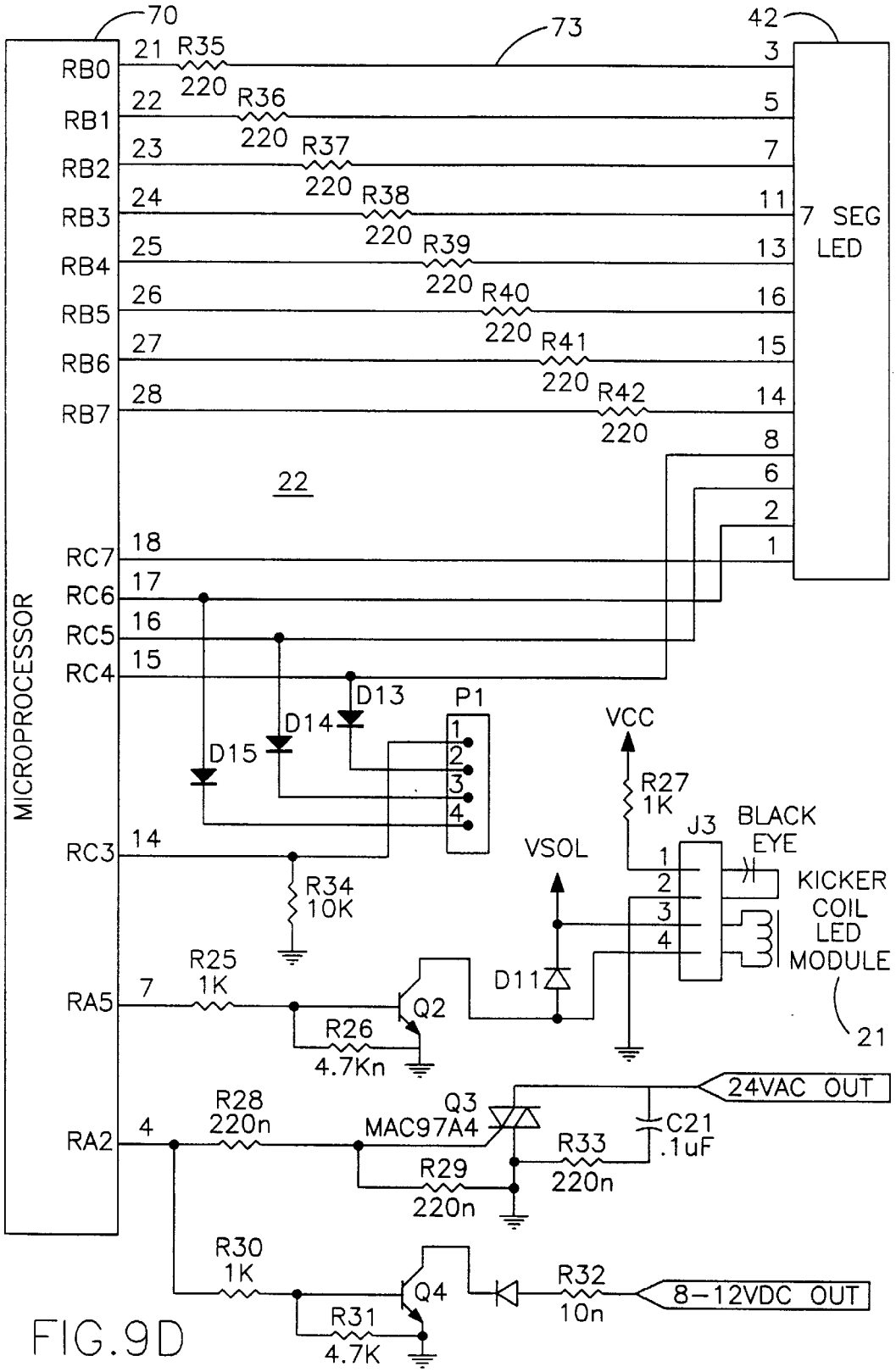

The microprocessor-based control 22 is illustrated in detail in FIGS. 9*a* and 9*b* in which FIG. 9*a* generally represents inputs to microprocessor 70 and FIG. 9*b* generally represents outputs of microprocessor 70. In the illustrated embodiment, microprocessor 70 is a Microchip PIC series 8-bit microprocessor with 2K of internal ROM and used with an erasable read-only non-volatile memory array. Each compare circuit 66*a*–66*c* is made up of an operational amplifier whose output is supplied through a capacitor to a junction of two diodes. The other terminal of one diode is supplied to a potentiometer which is adjusted by one of adjustment screws 46. The second terminal of the other diode is supplied as an input to the microprocessor. In this manner, the circuitry, including the sending and receiving coils, and the detecting circuitry is similar to that shown in commonly assigned U.S. Pat. Nos. 4,884,672 and 5,056,644. As an alternative, the output of each operational amplifier could be supplied directly as an input to microprocessor 70. Instead of discrete logic states, the signal supplied to microprocessor 70 would represent an analog signal that increases or decreases as a substantial match is produced between the test coin and the sample coin in the respective sample coin holder. The microprocessor would process the analog signals to determine when a match occurs between the test coin and a sample coin in a manner that would be apparent to the skilled artisan. While this alternative embodiment has the advantage of eliminating certain components, it would increase the amount of program code required by microprocessor 70 to evaluate the outputs of the compare circuits.

Other variations may suggest themselves to the skilled artisan. For example, although control circuit 22 is illustrated with a microprocessor, an application specific integrated circuit (ASIC), logic array, or analog circuitry could be substituted for the microprocessor. As previously observed, although three sample coin holders are illustrated, fewer or a greater number of sample coin holders could be utilized. The present invention is adaptable for use in both a long-drop and a short-drop frame and is capable of use with any combination of coin denomination and token. It has been discovered that not only is the coin analyzer 10 capable of discriminating between coins of similar characteristics, it provides other improvement over the Slug Buster II marketed by Parker Engineering & Manufacturing, Inc. of Grand Rapids, Mich. The sample coins in coin analyzer 10 can be readily positioned without the necessity for adjustment of the position of the coin, such as by the use of shims and the like. Alternatively, if shims are used to accurately position the sample coins in the sample coin holders, the requirements for potentiometers VR1–VR3 and associated adjustment screws, used to adjust the potentiometers, can be eliminated and replaced with fixed resistors.

Although the invention is illustrated for use with technology which compares the output of a test coin sensor with sample coin assemblies, its principles could be applied to other technologies. For example, the principles of the invention could be used with a microprocessor-based control which compares the output of a test coin sensor with parameters of coin denominations stored in memory associated with the microprocessor, such as of the type disclosed in U.S. Pat. Nos. 5,433,310 and 5,909,793, the disclosures of which are hereby incorporated herein by reference.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A method of discriminating among a plurality of coin denominations, comprising:

sensing the characteristics of a test coin with a test coin sensor and comparing the characteristics of the test coin with characteristics of a plurality of coin denominations thereby producing comparison signals;

if said comparing results in a match between the characteristics of the test coin and the characteristics of one of the coin denominations, then declaring the test coin to comprise the one of said coin denominations; and if said comparing results in matches between the characteristics of the test coin and the characteristics of more than one of the coin denominations, then comparing the matches to each other to determine which of said matches represents a valid match and declaring the test coin to comprise the coin denomination which corresponds to said valid match, wherein said comparing the matches to each other comprises determining which of said comparison signals begins first and whether both comparison signals persist substantially throughout the duration that a test coin is juxtaposed with said test coin sensor.

2. The method of discriminating in claim 1 wherein said producing comparison signals comprises producing said comparison signals the duration that a test coin is juxtaposed with said test coin sensor.

3. The method of discriminating in claim 1 including providing a test coin sensor and a plurality of sample coin assemblies, one for each of the plurality of coin denominations, wherein said comparing the characteristics of the test coin comprises comparing outputs of said test coin sensor with outputs of each of said sample coin assemblies.

4. A coin discrimination apparatus, comprising:

a plurality of sample coin assemblies, each adapted to holding a coin to be detected and including a sample coin coil assembly;

a test coin sensor, adapted to sense a coin to be detected and including a test coin coil assembly; and a control comparing said test coin coil assembly with each of said sample coin coil assemblies and determining whether a test coin at said test coin sensor matches a sample coin at one of said sample coin assemblies, wherein said control resolves apparent matches between a coin at said test coin sensor and sample coins at more than one of said sample coin assemblies by comparing the apparent matches to each other to determine which of the apparent matches represents a valid match.

5. The coin discrimination apparatus in claim 4 wherein said control compares apparent matches between a coin at said test coin sensor and the coins at more than one of said sample coin assemblies to determine which of the coins at more than one of said sample coin assemblies matches the coin at said test coin sensor.

6. The coin discrimination apparatus in claim 5 wherein said control determines which of the coins at more than one of said sample coin assemblies indicates a match with the coin at said test coin sensor substantially throughout the duration that the test coin is at the test coin sensor.

7. The coin discrimination apparatus in claim 4 wherein said control stores multiple samples of a coin at said test coin sensor while the coin is at said test coin sensor.

8. The coin discrimination apparatus in claim 4 wherein said control comprises a microprocessor-based control.

9. A coin discrimination apparatus, comprising:

a plurality of sample coin assemblies, each adapted to holding a coin to be detected and including a sample coin coil assembly;

a test coin sensor, adapted to sense a coin to be detected and including a test coin coil assembly; and a control comparing said test coin coil assembly with each of said sample coin coil assemblies and determining whether a test coin at said test coin sensor matches a sample coin at one of said sample coin assemblies, wherein said control is programmed to discriminate between coins of similar properties, wherein said control resolves apparent matches between a coin at said test coin sensor and sample coins at more than one of said sample coin assemblies, wherein said control compares apparent matches between a coin at said test coin sensor and the coins at more than one of said sample coin assemblies to determine which of the coins at more than one of said sample coin assemblies matches the coin at said test coin sensor, wherein said control determines which of the coins at more than one of said sample coin assemblies first indicates a match with the coin at said test coin sensor.

10. A coin discrimination apparatus, comprising:

a test coin sensor including a coin guide path and a test coil assembly generating a test field and sensing a test field with a test coin at said guide path; and a control responsive to said test coil assembly to determine whether a test coin at said guide path matches any of a plurality of coin denominations including resolving matches of a test coin at said test coin sensor with more than one of said plurality of coin denominations;

wherein said control determines which of the plurality of coin denominations first indicates a match with the coin at said test coin sensor.

11. The coin discrimination apparatus in claim 10 including a plurality of sample coin assemblies, each including a sample coin holder and a sample coil assembly generating a sample field and sensing a sample field with said holder holding a sample coin, wherein said control compares said test coil assembly with each of said sample coil assemblies.

12. The coin discrimination apparatus in claim 11 wherein each of said test coil assemblies and said sample coil assemblies comprises a field-generating coil and a field-sensing coil.

13. The coin discrimination apparatus in claim 11 wherein said field-generating coils are electrically series connected.

14. The coin discrimination apparatus in claim 13 wherein said field-sensing coils of said sample coil assemblies are each compared with the field-sensing coil of said test coil in order to produce signals indicative of matches between a test coin at the guide path and a sample coin at the respective sample coin assembly.

15. The coin discrimination apparatus in claim 14 wherein said control determines which of the coins at more than one of said sample coin assemblies indicates a match with the coin at said coin path by determining which of said signals is present substantially throughout the duration that the test coin is at the test coin sensor.

16. The coin discrimination apparatus in claim 14 wherein said control determines which of the coins at more than one of said sample coin assemblies indicates a match with the coin at said coin path by determining which of said signals is the first to be present when the test coin is at the test coin sensor.

17. The coin discrimination apparatus in claim 10 wherein said control stores multiple samples of a coin at said test coin sensor while the coin is at said test coin sensor.

18. The coin discrimination apparatus in claim 11 including at least three said sample coin assemblies.

19. The coin discrimination apparatus in claim 18 including a chassis and wherein said at least three sample coin assemblies are aligned with each other on said chassis.

20. The coin discrimination apparatus in claim 10 wherein said control determines which of the plurality of coin denominations indicates a match with the coin at said test coin sensor substantially throughout the duration that the test coin is at the test coin sensor.

21. The coin discrimination apparatus in claim 10 wherein said control comprises a microprocessor-based control.

22. The method of discriminating in claim 10 including providing a microprocessor-based control and comparing said test coil assembly with each of said sample coin coil assemblies using said control.

23. A method of discriminating denominations of coins, comprising:

providing a plurality of sample coin assemblies and a test coin sensor, each of said sample coin assemblies adapted to holding a coin to be detected and includes a sample coin coil assembly, said test coin sensor adapted to sense a coin to be detected and including a test coin coil assembly; and comparing said test coin coil assembly with each of said sample coin coil assemblies and determining whether a test coin at said test coin sensor matches a sample coin at one of said sample coin assemblies, and resolving matches of a test coin at said test coin sensor with sample coins at more than one of said sample coin holders by comparing said matches at more than one of said sample coin holders with each other to determine which of said matches at more than one of said sample coin holders represents a valid match.

24. The method of discriminating in claim 23 wherein each of said test coil assemblies and said sample coil assemblies comprises a field-generating coil and a field-sensing coil.

25. The method of discriminating in claim 24 wherein said field-generating coils are electrically series connected.

26. The method of discriminating in claim 24 including comparing each of said field-sensing coils of said sample coil assemblies with the field-sensing coil of said test coil and producing signals indicative of matches between a test coin at the guide path and a sample coin at the respective sample coin assembly.

27. The method of discriminating in claim 23 including determining which of the coins at more than one of said sample coin assemblies indicates a match with the coin at said test coin sensor by determining which of said signals is present substantially throughout the duration that the test coin is at the test coin sensor.

28. The method of discriminating in claim 27 including determining which of the coins at more than one of said sample coin assemblies indicates a match with the coin at said coin path by determining which of said signals is the first to be present when the test coin is at the test coin sensor.

29. The method of discriminating in claim 23 including storing multiple samples of a coin at said test coin sensor while the coin is at said test coin sensor.

30. The method of discriminating in claim 23 including determining which of the coins at more than one of said sample coin assemblies indicates a match with the coin at said test coin sensor substantially throughout the duration that the test coin is at the test coin sensor.

31. The method of discriminating in claim 23 including providing a coin path at said test coin sensor and selectively adjusting a dimension of said coin path as a function of diameters of sample coins in said sample coin assemblies.

32. A method of discriminating denominations of coins, comprising:

providing a plurality of sample coin assemblies and a test coin sensor, each of said sample coin assemblies adapted to holding a coin to be detected and includes a sample coin coil assembly, said test coin sensor adapted to sense a coin to be detected and including a test coin coil assembly; and comparing said test coin coil assembly with each of said sample coin coil assemblies and determining whether a test coin at said test coin sensor matches a sample coin at one of said sample coin assemblies, and resolving matches of a test coin at said test coin sensor with sample coins at more than one of said sample coin holders;

determining which of the coins at more than one of said sample coin assemblies first indicates a match with the coin at said test coin sensor.

33. A method of discriminating denominations of coins, comprising:

providing a plurality of sample coin assemblies and a test coin sensor, each of said sample coin assemblies adapted to holding a coin to be detected and includes a sample coin coil assembly, said test coin sensor adapted to sense a coin to be detected and including a test coin coil assembly; and comparing said test coin coil assembly with each of said sample coin coil assemblies and determining whether a test coin at said test coin sensor matches a sample coin at one of said sample coin assemblies, including determining whether any of the coins at more than one of said sample coin assemblies indicates a match with the coin at said test coin sensor substantially throughout the duration that the test coin is at the test coin sensor and which of the coins at more than one of said sample coin assemblies first indicates a match with the coin at said test coin sensor.

34. The method of discriminating in claim 33 wherein each of said test coil assemblies and said sample coil assemblies comprises a field-generating coil and a field-sensing coil.

35. The method of discriminating in claim 34 wherein said field-generating coils are electrically series connected.

36. The method of discriminating in claim 34 including comparing each of said field-sensing coils of said sample coil assemblies with the field-sensing coil of said test coil and producing signals indicative of matches between a test coin at the guide path and a sample coin at the respective sample coin assembly.

37. The method of discriminating in claim 33 including storing multiple samples of a coin at said test coin sensor while the coin is at said test coin sensor.

38. The method of discriminating in claim 33 including providing a microprocessor-based control and comparing said test coil assembly with each of said sample coin coil assemblies using said control.

* * * * *